United States Patent [19]

St. Peter

[11] 4,183,584

[45] Jan. 15, 1980

[54] DRESSING A ROCK FACE FOR ABANDONMENT

[76] Inventor: Albert L. St. Peter, 6820 E. Speedway Blvd., Tucson, Ariz. 85710

[21] Appl. No.: 895,498

[22] Filed: Apr. 11, 1978

[51] Int. Cl.[2] ..... E21C 47/00

[52] U.S. Cl. ..... 299/13; 102/23

[58] Field of Search ..... 405/258; 102/23; 299/13, 19

[56] References Cited

U.S. PATENT DOCUMENTS

| | | | |
|---|---|---|---|
| 1,043,784 | 11/1912 | Lucas | 299/13 |
| 1,872,016 | 8/1932 | Sherwood et al. | 299/13 |

FOREIGN PATENT DOCUMENTS

| | | | |
|---|---|---|---|
| 1385793 | 1/1964 | France | 102/23 |
| 371347 | 6/1973 | U.S.S.R. | 299/13 |

*Primary Examiner*—William F. Pate, III

[57] ABSTRACT

Horizontal entry tunnels are cut into or behind the rock face at selected distances and depths. From these entries cross-cut tunnels can be driven. Series of vertical under-reamed holes also can be driven down from terrain level to become part of the tunnel blast system. All cross-cut tunnels and vertical holes are loaded with explosives except for stemmed portions and exploded either simultaneously or delayed. The broken rock is thereby blown onto the pit floor and into the void created by the blasts to the complete elimination of the vertical rock face and with the production of a nearly even gentle slope of specified grade.

7 Claims, 7 Drawing Figures

DRESSING A ROCK FACE FOR ABANDONMENT

BACKGROUND OF THE INVENTION

1. Field of the Invention

This invention relates to fragmentation by the open pit method and particularly, after the ore body has been exhausted and mining operations completed, relates to putting the pit and surrounding land in condition for future usefulness, and for the satisfaction of esthetic and practical considerations.

2. Description of the Prior Art

It has been the usual custom in the past simply to abandon a worked-out open pit. It then became an eyesore and perphaps a hazard. Often the pit filled with water, children swam in it and drownings occurred. The pit area was useless to farmers and ranchers and became a waste area.

Objections have been raised to this practise of abandoning open pits after exhausting the minerals from them and governmental entities have passed laws requiring miners to put the pit and the surrounding area back in such shape that it can again be useful, safe and not an eyesore.

For example, States have passed laws that the residual pit wall, after exhaustion and prior to abandonment, must be cut down to a slope of not greater than 3 to 1 (three units horizontally and one vertically), 4 to 1 or 5 to 1. The conventional way of doing this has been by progressively cutting away the surface in lifts down to the required sloping plane. This is an expensive, time-consuming and equipment-intensive process.

SUMMARY OF THE INVENTION

This invention provides a process for the elimination of the dangers and uneconomic conditions created by leaving vertical or steep faces standing in an abandoned open pit or in a worked-out portion of a continuing operation, and for restoring the area to usefulness and to a good appearance.

The general concept is to cut tunnels and drill holes, charge them and blast so that the face and some portion of the rock behind it are broken and thrown out. The resultant slope of the blasted rock will approximate the desired final slope to be left, with some minor dressing by grading equipment.

The process of this invention teaches where to drive tunnels into the rock face, or from the side, with perhaps supplemental cross tunnels and vertical under-reamed holes drilled from the top. These tunnels and bore holes are so stragetically placed that, when loaded with explosives, properly stemmed, then detonated, the broken rock will be so blasted out onto the pit floor and back into the blast-created voids that the blasted broken rock is deposited and distributed in such amount as to form a smooth slope from the terrain to the pit floor at the desired angle to the surrounding terrain level. This desired result is thus accomplished by blasting, eliminating any need for cutting down from above, or for grading or dressing except for that minor grading required to smooth the final slope, and for the addition of any top dressing and re-vegitating.

One object of this invention is to provide a process for converting an exhausted open pit to a usable configuration suitable, after further restoration, for such use of the land surface as might have been made before the open pit operation was started.

Another object is to provide a process economical of time, materials and energy for restoring an exhausted open pit to the condition required by law.

DESCRIPTION OF THE PREFERRED EMBODIMENTS

Figure 1:
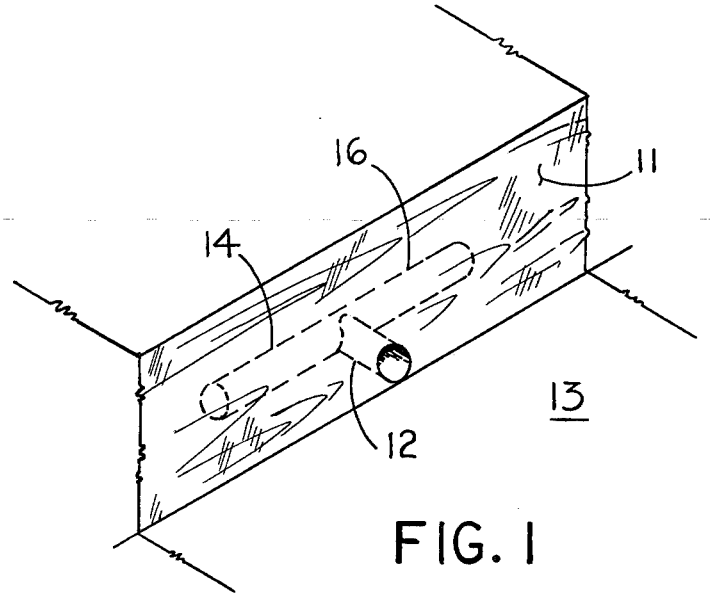
FIG. 1 is a perspective schematic view of a rock face in an abandoned pit with dashed lines indicating a single tunnel system.

Referring to FIG. 1, 11 indicates a part of a vertical rock face left after abandonment of an open pit mining operation. In this face an entry tunnel, adit or passageway 12 is shown driven in the face at the level of the pit floor 13 for the purpose of this invention. From the adit and at a selected distance from its mouth two horizontal cross tunnels, 14 and 16, are indicated in line or somewhat off line.

Figure 2:
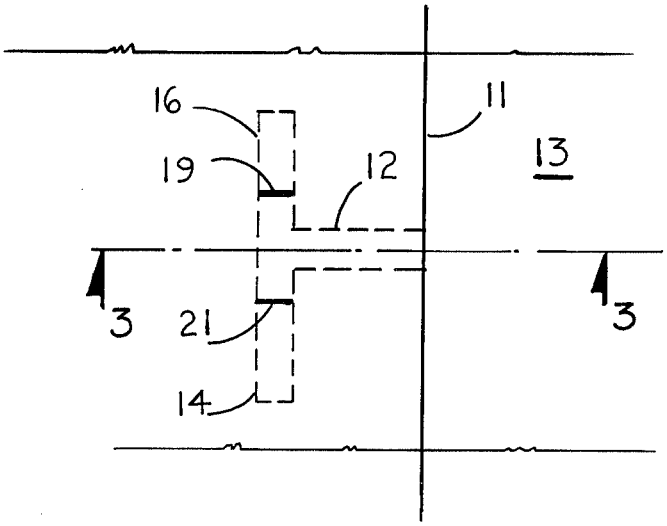
FIG. 2 is a plan view of a rock face similar to that of FIG. 1 and with a similar tunnel system.
Figure 3:
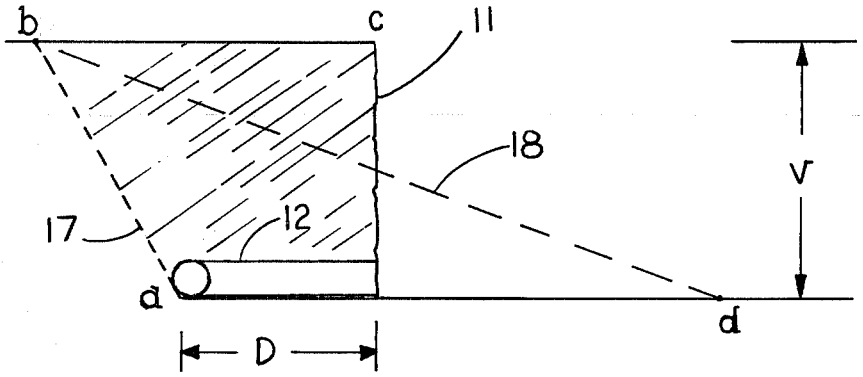
FIG. 3 is a cross section of FIG. 2 on the line 3—3.

In FIGS. 2 and 3 the same tunnel system of FIG. 1 is depicted. Dashed line 17 indicates the slope of the rock face which will be left after blasting. Dashed line 18 indicates the slope of broken rock after the blasts have demolished the rock face and rock behind the face and have thrown the broken rock up and out.

The ratio of the length D, FIG. 3, of the adit tunnel 12 to the height V of the rock face should be between 0.5 and 0.9. The exact optimum length of D does not depend entirely on the face height V but is also somewhat influenced by the kind of rock and the formation of the mass.

If the face height V is less than about 80 feet it may be more economical to use present conventional methods of drilling and blasting from terrain level. The single-tunnel system of FIGS. 1, 2 and 3 is practical and economical up to a 180-foot face height, depending on the type of rock, formation, slope of face and other factors.

The general design of explosive tunnels and blast holes for use in this process is such that the mass of broken rock produced by one or more tunnel systems of selected depths into the face, plus wings in one or both directions parallel to the face, will fill the void created by the blast and throw rock onto the pit floor to produce a desired finished slope. As broken rock has a volume 30% to 60% greater than that of the original solid rock, this swelling must be taken into consideration. The angle abc, FIG. 3, must be selected to produce the needed volume of broken material, The angle dbc of the final slope 18 will be as required by the plan of operation.

The cross tunnel section between 19 and 21, FIG. 2, and also the entry tunnel 12, are stemmed or packed with inert material so as to prevent the charges in 14 and 16 from blowing out through 12.

In the use of the tunnel design shown in FIGS. 1, 2 and 3, the process of changing a vertical rock face to a slope of selected angle comprises: drilling and tunnelling to make a selected system; loading with explosives, stemming and detonating. The resulting slope of broken rock on the pit floor and in the blast vicinity will closely approximate the desired slope angle and will require only minor grading before preparing for use. The dangerous and ugly pit formation will have been eliminated.

Figure 4:
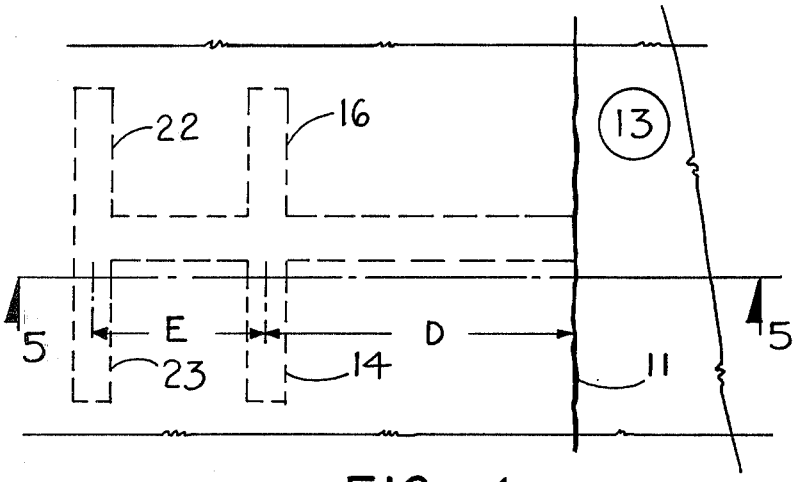
FIG. 4 is a plan view of a rock face with tunnels cut in from the face at floor level.
Figure 5:
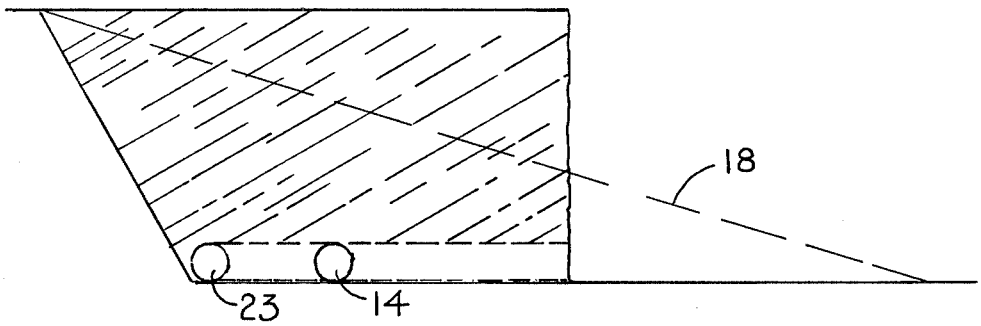
FIG. 5 is an elevation section of the rock face of FIG. 4 on the line 5—5.

In cases where the height of face is considered too much for a single tunnel system, one or more supplemental tunnels, such as 22 and 23, FIG. 4, can be driven parallel to the wings but at a distance E behind them. This distance E should be 30% to 80% of the distance D.

There may be situations which preclude starting the entry tunnels from the face. In such a case, entry may be made from the side, off the end of the area to be blasted. The entry tunnel is then angled so that at the designed depth behind the face it can be run parallel to the face as in the tunnel 14/16, FIG. 2.

Figure 6:
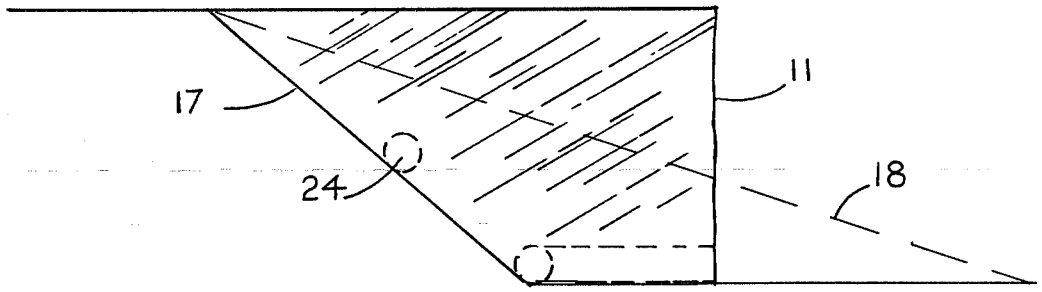
FIG. 6 is a schematic elevation of a rock face showing a supplemental tunnel cut behind and above the main tunnel system.

In some cases, as when a flatter resultant pattern is required, supplemental tunnels 24, FIG. 6, are cut at the rock slope 17 above the floor level.

Figure 7:
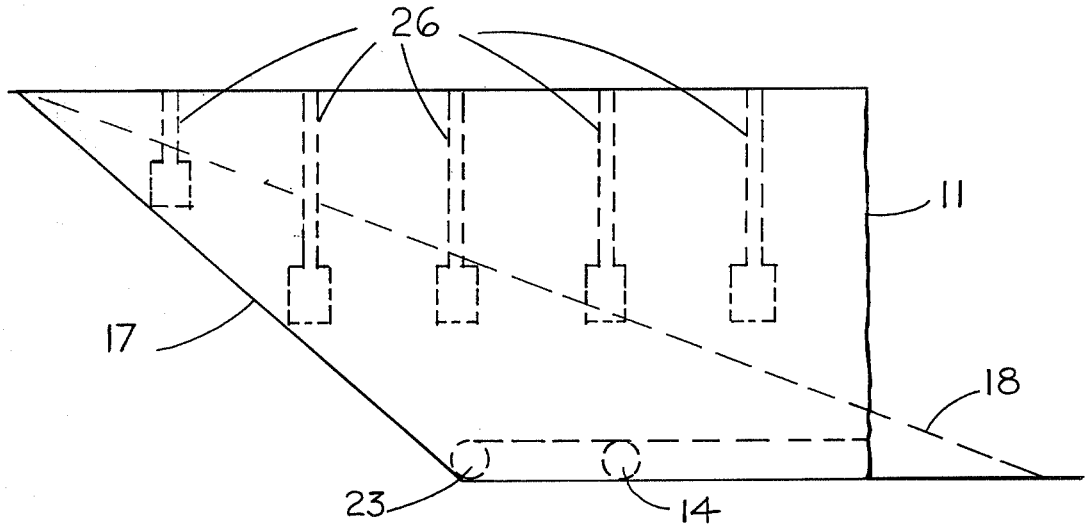
FIG. 7 is a schematic elevation of a rock face with under-reamed surface-drilled holes supplemental to tunnel systems in high rock formations.

In cases where it is impractical or uneconomic to enter the side of the mass or to enter from the face to cut supplemental tunnels 24, under-reamed (chambered) holes will be drilled from the surface, as shown as drill holes 26, FIG. 7, to a selected distance above the slope of the final rock face 17, FIG. 7. These holes, for example, will be drilled with a diameter of 12 inches. At the selected depths they will be under-reamed to, for example, 30 inches diameter down to a selected height over the tunnels and the line 17. These drilled holes are loaded with explosives, including the under-reamed volumes, and detonated with the tunnel detonations or slightly delayed thereafter. The number of under-reamed holes, placement and the lengths of enlargements are functions of the amount of material to be broken and moved. These drilled and under-reamed holes take the place of supplemental tunnel systems 24 on slope 17, FIG. 6.

Under-reamed holes drilled from the top are used in another way when the height of the face is over 200 feet. In such cases the main and supplemental tunnel systems are supplemented by holes 26, FIG. 7, drilled from the surface above to depths bottoming at 100 to 150 feet above the tunnel systems. These holes are loaded, including the under-reamed parts, with explosives, with appropriate stemming, for detonation with or slightly delayed after the tunnels.

What is claimed is:

1. In an upright faced rock formation to be dressed to a gentle slope, said formation being over 120 feet in height, the process of dressing the face by blasting comprising:

cutting an adit at the foot of said formation, said adit having a predetermined length relative to the height of the rock formation;

at the inner end of said adit cutting at least one first pair of approximately horizontal cross tunnels normal to the adit;

cutting at least one additional supplemental approximately horizontal cross tunnel substantially above said formation foot and at the slope of the rock face to be left after blasting, and on the side of said first pair distant from the rock face;

charging said tunnels with explosives;

stemming said tunnels;

stemming the adit; and detonating the explosives whereby the resulting broken rock forms an evenly sloped surface of predetermined slope.

2. In an upright faced rock formation to be dressed to a gentle slope, said formation being over 120 feet in height, the process of dressing the face by blasting comprising:

cutting an adit at the foot of said formation, said adit having a predetermined length relative to the height of the rock formation;

at the inner end of said adit cutting at least one first pair of approximately horizontal cross tunnels normal to the adit;

charging at least one first pair of tunnels with explosives;

stemming said tunnels;

stemming the adit; and detonating the explosive charges whereby the resulting broken rock forms an evenly sloped surface of predetermined slope.

3. A process in accordance with claim 2 comprising:

cutting at least one additional supplemental approximately horizontal cross tunnel substantially above said formation foot and at the slope of the rock formation face to be left after blasting, and on the side of first pair distant from the rock face;

charging said at least one additional supplemental approximately horizontal cross tunnel with explosives and stemming; and detonating said explosives substantially with the detonation of the explosives in the said at least one first pair of tunnels.

4. A process in accordance with claim 2 comprising:

cutting a first pair of horizontal cross channels from said adit;

from said adit cutting at least one additional supplemental horizontal cross channel on the side of said first pair of cross channels distant from said rock face;

charging said tunnels with explosives and stemming; and detonating said explosives whereby the resulting broken rock forms an evenly sloped surface.

5. A process in accordance with claim 2 comprising:

cutting said adit at the foot of the rock face substantially horizontal and normal to the face, the length being determined partly but not exclusively by the height of the face and thereby taken as 0.5 to 0.9 of the height of the face.

6. A process in accordance with claim 4 in which said at least one additional supplementary horizontal cross channel is located behind said first pair of cross channels by a distance which is 0.3 to 0.8 of the length of said adit.

7. In the dressing by blasting of an upright faced rock formation over two hundred feet in height, a process in accordance with claim 2 comprising:

drilling substantially vertical holes down from the top or original terrain level;

under-reaming said vertical holes;

filling said vertical holes with explosives and stemming; and exploding said vertical holes substantially at the same time as the detonation of said cross tunnels.

* * * * *